US006617535B2

(12) United States Patent
Lacroix

(10) Patent No.: US 6,617,535 B2
(45) Date of Patent: Sep. 9, 2003

(54) CONTROL DEVICE FOR A CONTACTOR, COMPRISING A TRANSMITTER, AND A TRANSMITTER FOR THIS DEVICE

(75) Inventor: Louis Lacroix, Champigny S/Marne (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/971,577

(22) Filed: Oct. 9, 2001

(65) Prior Publication Data

US 2002/0040843 A1 Apr. 11, 2002

(30) Foreign Application Priority Data

Oct. 11, 2000 (FR) ..... 00 13014

(51) Int. Cl.[7] ..... H01H 13/00

(52) U.S. Cl. ..... 200/339; 200/6 R; 200/315; 200/336

(58) Field of Search ..... 200/339, 6 R, 200/315, 336

(56) References Cited

U.S. PATENT DOCUMENTS 4,947,008 A * 8/1990 Sato et al. ..... 200/6 R

FOREIGN PATENT DOCUMENTS

DE 4334046 C * 3/1995
EP 0817226 A * 1/1998

* cited by examiner

*Primary Examiner*—Lincoln Donovan
*Assistant Examiner*—Jennifer A Poker
(74) *Attorney, Agent, or Firm*—Liniak, Berenato & White

(57) ABSTRACT

A control device for a contactor, in particular for scrolling through a menu which allows appliances in a motor vehicle to be controlled. The control device comprises a control key (36) mounted pivoting on a support, at least one contactor (4), and a tie bar (20, 22) interposed between the key (36) and each contactor (4). A, preferably transparent, transmitter (16) is formed by a supporting structure (18) and at least one tie bar (20, 22). The tie bars are connected to the supporting structure by at least one flexible arm so as to transmit to the contactor an action performed on the key (36). The supporting structure (18) serves as a support and a pivot for the control key (36).

11 Claims, 2 Drawing Sheets

CONTROL DEVICE FOR A CONTACTOR, COMPRISING A TRANSMITTER, AND A TRANSMITTER FOR THIS DEVICE

FIELD OF THE INVENTION

The invention relates to a control device for a contactor.

More precisely, it relates to a control device comprising a control key mounted pivoting on a support, at least one contactor arranged facing a region of the key offset relative to its axis of articulation, and an elongate tie bar, the opposite ends of which co-operate respectively with one contactor and with the said region of the corresponding key. It can be used especially but not exclusively to drive a scrolling menu which allows appliances in a motor vehicle to be controlled.

BACKGROUND OF THE INVENTION

Control devices of this type are already known. They have a key mounted so as to rock on an intermediate plate arranged between the front face of the casing and a printed circuit board. The rocker key acts on one or more tie bars guided in the intermediate plate. Each of these tie bars actuates one contact of a push button mounted on the printed circuit board.

This device has a number of disadvantages. The number of parts is significant and assembly is time-consuming and intricate.

Embodiments of the present invention may at least partially remedy these disadvantages.

SUMMARY OF THE INVENTION

The present invention proposes a control device which has a reduced number of parts and can be assembled rapidly and easily.

To this end, the tie bar forms part of a transmitter formed in one piece and furthermore comprising a supporting structure arranged facing the key and mounted in a fixed manner with respect to the contactor, the tie bar being connected to the supporting structure by at least one flexible arm, which allows it to be displaced substantially parallel to the structure so as to transmit to the contactor a pressure exerted on the key.

The transmitter thus constitutes a piece formed in a single unit which includes one or more tie bars and the means for guiding these tie bars. It can be fitted very easily, simply by placing it on a printed circuit board having one or more contactors, for example.

The supporting structure of the transmitter preferably serves as a support and a pivot for the control key.

By virtue of this characteristic, the intermediate plate which, in the prior art, served as a pivot or hinge for the control key, can be dispensed with. The number of parts is thus reduced even further.

The key preferably has a flared seat which receives part of the supporting structure, which forms a pivot for the key.

The control device advantageously comprises a casing having a front face comprising a flared seat, which receives an articulation surface of the key. This front face has grooves and the supporting structure has sliding surfaces, which are accommodated in the said grooves.

According to a particular embodiment, the supporting structure is in the form of a T formed by an upright and a transverse beam. The supporting structure can have a stepped part at each of its ends, each stepped portion comprising a lower step, which forms a pivot for the key, and an upper step. The upper steps of the stepped portions advantageously form sliding surfaces which engage in the grooves in the front of the casing.

In one embodiment, the tie bar is connected to the supporting structure by two flexible arms, defining a deformable parallelogram. In another embodiment, the tie bar is connected to the supporting structure by a single flexible arm, one end of the tie bar cooperating with the contactor by nesting with it.

The transmitter is advantageously made from a transparent material. This arrangement makes it easier to illuminate the key by means of a light source, allowing it to be identified easily in the dark.

Finally, the invention relates to a transmitter suitable for forming part of a control device as defined above, comprising a supporting structure and at least one elongate tie bar connected to the supporting structure by at least one flexible arm.

BRIEF DESCRIPTION OF THE DRAWINGS

Other characteristics and advantages of the invention will become further apparent in reading the following description of two exemplary embodiments given by way of illustration with reference to the attached figures, in which.

DETAILED DESCRIPTION OF THE PREFERRED EMBODIMENT

Figure 1:
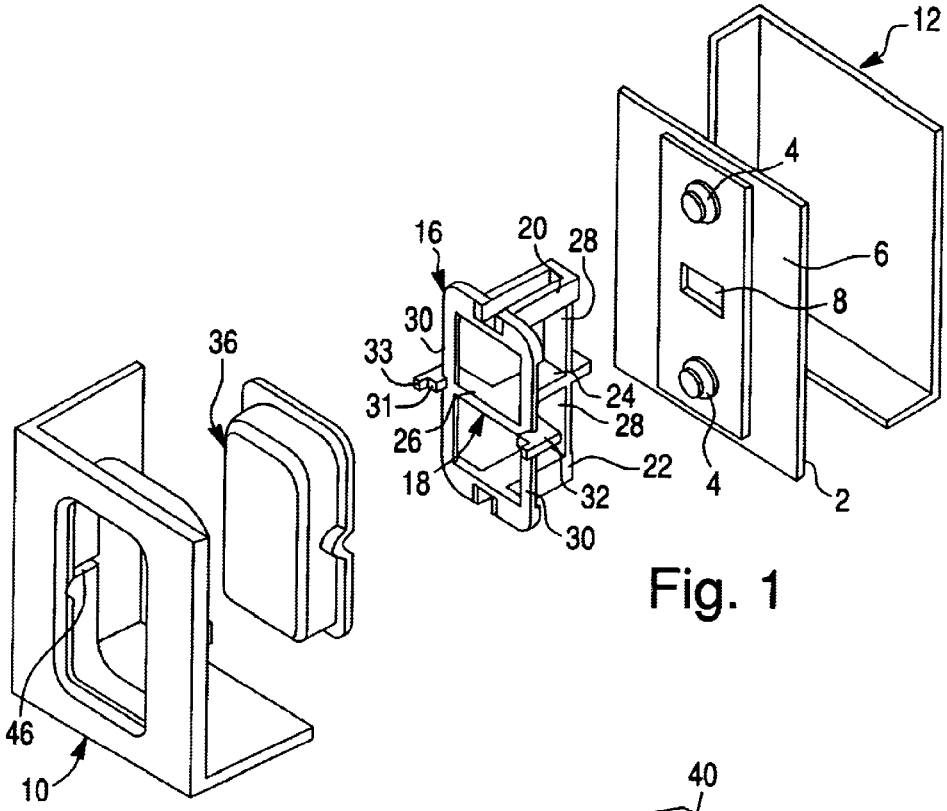
FIG. 1 is an exploded view in perspective of a control device in accordance with the present invention.

The control device in accordance with the invention and shown in exploded view in FIG. 1 has a printed circuit board 2, on which two contactors 4 are fixed via a plate 6, in which an aperture 8 is formed halfway between the contactors 4. In this case, the contactors are push buttons. As a variant, they can be replaced by a bubble-switch panel. The printed circuit board 2 is housed within a casing comprising a front face 10 and a rear cover 12.

Figure 2:
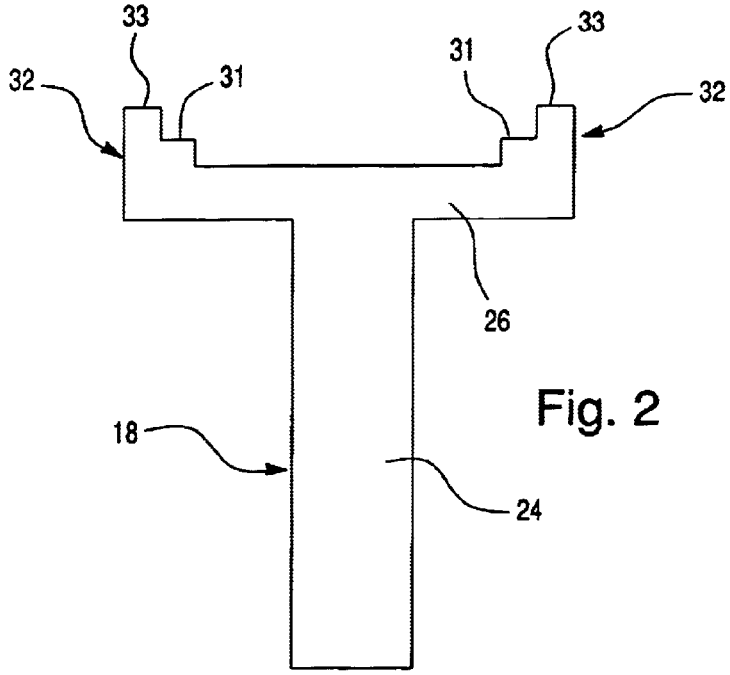
FIG. 2 is a view in elevation of the supporting structure of the transmitter of the control device shown in FIG. 1.

The device has a transmitter designated overall by the reference 16. The transmitter has a supporting structure 18 and two elongate tie bars 20 and 22 respectively aligned with the contactors 4. In the exemplary embodiment shown (see FIG. 2), the supporting structure is T-shaped, consisting of a beam 24 which forms the stem of the T and of a second beam 26, perpendicular to the beam 24, which forms the crossbar of the T. A stepped portion 32 facing away from beam 24 is formed at each end of beam 26. This portion has a lower step 31 and an upper step 33.

The tie bars 20 and 22 are connected to the supporting structure 18 by flexible arms. In the example described, each of the tie bars 20 and 22 is connected by a single arm 28 to the beam 24 and by a double arm 30 to the two ends of beam 26.

Finally, the control device comprises a key 36. In the example described, the key 36 is of the rocking type. It is supported in its central portion on the two lower steps 31 of the stepped portions 32 formed at each end of the horizontal bar 26 of the supporting structure 18.

The transmitter 16 is made of a transparent plastic material, allowing the key to be illuminated by a light source such as a diode. It can thus be identified easily in the dark.

Figure 3:
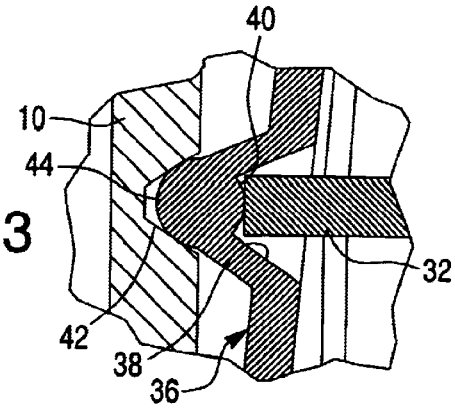
FIG. 3 is a detail view on an enlarged scale of the articulation of the key on the supporting structure of the control device shown in FIG. 1.

The way in which the key 36 is articulated on the supporting structure 18, which forms a support and a pivot for the key 36, has been shown in greater detail in FIG. 3. The key 36 has a flared seat 38 in the form of a V. A bearing 40 in the form of a portion of a cylinder of revolution is formed at the bottom of the V-shaped seat 38. The cylindrical surface 40 rests on the lower step 31 of the stepped portion 32.

In the same way, the front face 10 of the casing has a flared seat 42, which receives a cylindrical articulation surface 44 of the key 36 belonging to the same cylinder of revolution as the surface 40

The two upper steps 33 of the stepped portions 32 form sliding surfaces which penetrate into corresponding grooves 46 of appropriate shape formed in the front face 10 of the casing.

Figure 4:
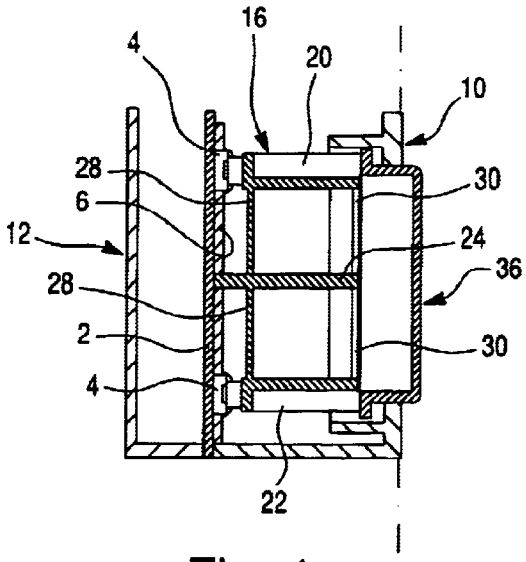
FIG. 4 is a view in section of the control device in FIGS. 1 to 3 shown in the rest position.

FIG. 4 shows a sectional view of the control device according to the invention in the rest position. The device can be assembled simply by placing one part upon another. The transmitter 16 is simply placed on the printed circuit board 2, the free end of the beam 24 coming to rest in the aperture 8 provided in the plate 6 placed on the printed circuit board 2. In this position of the transmitter 16, the tie bars 20 and 22 each rest on a contactor 4 provided on the printed circuit board. The key 36 is then placed on the transmitter in such a way that the flared seats 38 cover the lower steps 31 of the two stepped portions 32, the width of the key being such that it can protrude between the two upper steps 33 of this same portion. The front face 10 of the casing is then placed on top of the key 36. The cylindrical articulation surfaces 44 of the key come to rest in the flared seats 42 formed in the rear face of the front face 10 of the casing. The key is thus fixed between the supporting structure 18 and the front face 10 of the casing. However, it can nevertheless pivot on the end of the supporting structure thanks to the presence of the cylindrical surfaces 40 and 44. The axis of the cylindrical surfaces 40 and 44, which is perpendicular to the plane of the figure, forms an axis of rotation for the key 46.

Figure 5:
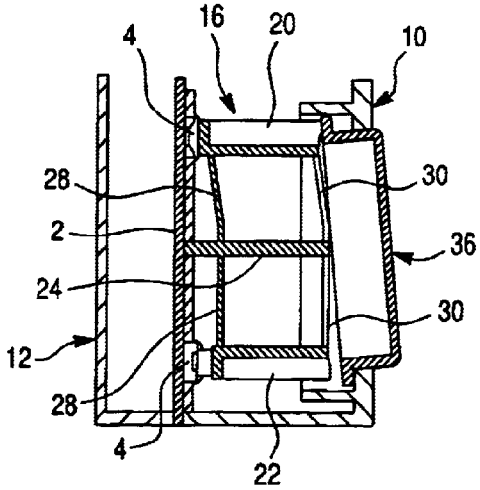
FIG. 5 is a view similar to FIG. 4, the key being shown in the tilted position.

FIG. 5 shows the position of the control key 36 when pressure, as shown symbolically by the arrow F, is exerted on the latter in its upper end region facing one of the contactors 4. The key 36 pivots about its axis of rotation as described above. The pressure F exerted on the key 36 is transmitted to the contactors 4 via tie bar 20. The two flexible arms 28 and 30 allow tie bar 20 to be displaced freely in translation. With the latter and the supporting structure 18, they form a deformable parallelogram which keeps the tie bar perpendicular to the printed circuit board, allowing it to act axially on the contactor 4.

In FIG. 4, a free space will be seen between the periphery of the key 36 and the front face 10 of the casing. In FIG. 5, it will be seen that this space allows the key to pivot through an angle of approximately 5° to 10°, which is sufficient to close the contactor 4. When the effort F ceases, the key resumes its initial position shown in FIG. 4 under the effect of the restoring force exerted by the return spring of the contactor 4. In imposing opposite forces on the key 36, the two contactors 4 thus keep it in its position of equilibrium at rest, as shown in FIG. 4.

Figure 6:
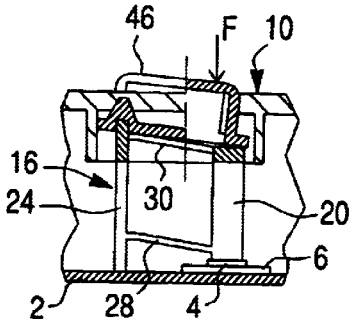
FIG. 6 is a schematic view in partial section of a variant embodiment of the invention having a hinged key.

FIG. 6 shows a sectional view of a variant embodiment of the invention. In this variant, the control key 46 is no longer articulated in the middle on the supporting structure 18 of the transmitter, like the key 36, but at one of its ends. As a consequence, the device has only one contactor 4 and one tie bar 20. In the left-hand part of the figure, the sectional plane passes through the area of articulation of the hinged key 46 on the supporting structure, in a manner similar to that shown on an enlarged scale in FIG. 3. In the right-hand part of FIG. 6, the sectional plane passes through the center of the key in the same way as that shown in FIGS. 4 and 5. As described above, when a force F is exerted on the end of the key 46, this force is transmitted to the contactor 4 via the tie bar 20. This contactor closes. When the force F diminishes, the key 46 resumes a rest position (not shown) in the same way as the rocker key described above.

The control device which has just been described makes it possible to actuate contactors, particularly contactors forming part of an electrical circuit printed on a card. It applies particularly to the selection of values from a scrolling menu for the purpose of controlling appliances such as a heating or air-conditioning system for the vehicle. The rocker key shown in FIGS. 1 to 5 makes it possible to scroll through the menu in both directions. When the upper part of the key is pressed, for example, the value on the menu is incremented. Conversely, when the lower part of this key is pressed, the value on the menu is decremented. In contrast, the control device shown in FIG. 6 allows the values on the menu to be scrolled in only one direction. To return to the initial value, it is necessary to run through all the values on the menu.

As can be observed, this device is particularly simple because it has a very small number of parts, i.e. essentially the transmitter and the control key. The transmitter can be produced at low cost by molding. Moreover, the device is likewise very simple to assemble since the various pieces merely have to be placed one on top of the other. This gives a simple control device which operates reliably and the cost of which is particularly low.

In the examples illustrated, the tie bar or each tie bar is connected to the supporting structure by two flexible arms in the vicinity of its two ends. As a variant, a single arm can be provided, in particular in the vicinity of the end of the tie bar which faces the key, the opposite end cooperating with the contactor, by nesting with it for example, so as to fix it in a plane perpendicular to the longitudinal direction of the tie bar.

Throughout the description, reference has been made to keys and rockers used particularly for selecting values from a scrolling menu so as to control various appliances. However, it is clear that these control devices could control other functions not limited to scrolling menus.

Similarly, the assembly process described above by way of example is intended specifically for the assembly of a single key or a single rocker. When assembling a plurality of keys, however, it is advantageous to reverse the process by turning the front around and mounting the keys, the transmitter and then the printed circuit board on it, in that order.

What is claimed is:

1. Control device comprising a control key (36, 46) mounted pivoting on a support, at least one contactor (4) disposed on a plate (6) and arranged facing a region of the key offset relative to an axis of articulation, and an elongate tie bar (20, 22), the opposite ends of said tie bar co-operate respectively with one contactor (4) and with said region of the corresponding key (36, 46), wherein the tie bar forms part of a transmitter (16) formed in one piece and sandwiched between the key (36, 46) and said plate (6), said control device furthermore comprising a supporting structure (18) arranged facing the key (36, 46) and mounted in a fixed manner with respect to the contactor (4), the tie bar (20, 22) being connected to the supporting structure (18) by at least one flexible arm (28, 30), which allows said tie bar to be displaced substantially parallel to the structure so as to transmit to the contactor (4) a pressure exerted on the key (36, 46).

2. Control device according to claim 1, wherein the supporting structure (18) of the transmitter (16) serves as a support and a pivot for the control key (36, 46).

3. Control device according to claim 2, wherein the key (36) has a first flared seat (38) which receives part (31) of the supporting structure (18), which forms a pivot for the key (36).

4. Control device according to claim 1, further comprising a casing having a front face (10) comprising a second flared seat (42), which receives an articulation surface (44) of the key (36, 46).

5. Control device comprising a control key (36, 46) mounted pivoting on a support, at least one contactor (4) arranged facing a region of the key offset relative to an axis of articulation, and an elongate tie bar (20, 22), the opposite ends of said tie bar co-operate respectively with one contactor (4) and with said region of the corresponding key (36, 46), wherein the tie bar forms part of a transmitter (16) formed in one piece and furthermore comprising a supporting structure (18) arranged facing the key (36, 46) and mounted in a fixed manner with respect to the contactor (4), the tie bar (20, 22) being connected to the supporting structure (18) by at least one flexible arm (28, 30), which allows said tie bar to be displaced substantially parallel to the structure so as to transmit to the contactor (4) a pressure exerted on the key (36, 46);

further comprising a casing having a front face (10) having grooves (46), wherein the supporting structure (18) has sliding surfaces (33), which are accommodated in said grooves.

6. Control device according to claim 1, wherein the supporting structure (18) defines a T-shape formed by an upright (24) and a transverse beam (26).

7. Control device according to claim 1, wherein the supporting structure (18) has a stepped portion (32) at each of two ends, each stepped portion comprising a lower step (31), which forms a pivot for the key, and an upper step (33).

8. Control device according to claim 7, further comprising a casing having a front face (10) having grooves (46), wherein the supporting structure (18) has sliding surfaces (33), which are accommodated in said grooves, wherein the upper steps (33) of the stepped portions (32) form sliding surfaces which engage in the grooves (46) in the front face (10) of the casing.

9. Control device comprising a control key (36, 46) mounted pivoting on a support, at least one contactor (4) arranged facing a region of the key offset relative to an axis of articulation, and an elongate tie bar (20, 22), the opposite ends of said tie bar co-operate respectively with one contactor (4) and with said region of the corresponding key (36, 46), wherein the tie bar forms part of a transmitter (16) formed in one piece and furthermore comprising a supporting structure (18) arranged facing the key (36, 46) and mounted in a fixed manner with respect to the contactor (4), the tie bar (20, 22) being connected to the supporting structure (18) by at least one flexible arm (28, 30), which allows said tie bar to be displaced substantially parallel to the structure so as to transmit to the contactor (4) a pressure exerted on the key (36, 46);

wherein the tie bar (20, 22) is connected to the supporting structure (18) by two flexible arms (28, 30), defining a deformable parallelogram.

10. Control device comprising a control key (36, 46) mounted pivoting on a support, at least one contactor (4) arranged facing a region of the key offset relative to an axis of articulation, and an elongate tie bar (20, 22), the opposite ends of said tie bar co-operate respectively with one contactor (4) and with said region of the corresponding key (36, 46), wherein the tie bar forms part of a transmitter (16) formed in one piece and furthermore comprising a supporting structure (18) arranged facing the key (36, 46) and mounted in a fixed manner with respect to the contactor (4), the tie bar (20, 22) being connected to the supporting structure (18) by at least one flexible arm (28, 30), which allows said tie bar to be displaced substantially parallel to the structure so as to transmit to the contactor (4) a pressure exerted on the key (36, 46);

wherein the tie bar (20, 22) is connected to the supporting structure (18) by a single flexible arm, one end of the tie bar cooperating with the contactor (4) by nesting with the contactor (4).

11. Control device according to claim 1, wherein the transmitter (16) is made from a transparent material.

* * * * *